US006874482B2

(12) United States Patent
Lahner et al.

(10) Patent No.: US 6,874,482 B2
(45) Date of Patent: Apr. 5, 2005

(54) DIAPHRAGM CARBURETOR WITH AIR PURGE SYSTEM

(75) Inventors: William Lahner, Cedarburg, WI (US); Gregory Orzal, Hartford, WI (US)

(73) Assignee: Wacker Corporation, Menomonee Falls, WI (US)

( * ) Notice: Subject to any disclaimer, the term of this patent is extended or adjusted under 35 U.S.C. 154(b) by 0 days.

(21) Appl. No.: 10/430,706

(22) Filed: May 6, 2003

(65) Prior Publication Data

US 2004/0221836 A1 Nov. 11, 2004

(51) Int. Cl.[7] ..... F02M 1/00
(52) U.S. Cl. ..... 123/516; 123/179.9; 123/337
(58) Field of Search ..... 123/516, 337, 123/179.9, 179.17

(56) References Cited

U.S. PATENT DOCUMENTS

| | | | | | |
|---|---|---|---|---|---|
| 3,620,195 | A | * | 11/1971 | Lamm et al. | 123/207 |
| 3,789,819 | A | | 2/1974 | Moulds | |
| 4,079,717 | A | | 3/1978 | Shirose | |
| 4,356,801 | A | * | 11/1982 | Graham | 123/337 |
| 4,684,485 | A | | 8/1987 | Scott | |
| 4,730,592 | A | | 3/1988 | Uozumi et al. | |
| 4,732,131 | A | | 3/1988 | Hensel | |
| 4,836,157 | A | | 6/1989 | Miller | |
| 4,893,594 | A | * | 1/1990 | Kobayashi | 123/179.9 |
| 4,905,641 | A | | 3/1990 | Miller | |
| 5,063,891 | A | * | 11/1991 | Noisier | 123/179.9 |
| 5,398,660 | A | | 3/1995 | Koyama et al. | |
| 5,660,765 | A | * | 8/1997 | King et al. | 261/39.3 |
| 5,740,781 | A | | 4/1998 | Scott et al. | |
| 6,000,369 | A | | 12/1999 | Koizumi | |
| 6,135,428 | A | * | 10/2000 | Schliemann et al. | 261/35 |
| 6,227,176 | B1 | * | 5/2001 | Hettmann | 123/516 |
| 6,269,799 | B1 | | 8/2001 | Watanabe et al. | |
| 6,374,810 | B1 | | 4/2002 | Pattullo | |
| 6,425,573 | B1 | * | 7/2002 | Suzuki | 261/35 |

OTHER PUBLICATIONS

Lombardini Fuel Injection System and De–aeration Pipe (diagram labeling parts).
Lombardini Engine Information Label (actual picture).

* cited by examiner

*Primary Examiner*—Weilun Lo
(74) *Attorney, Agent, or Firm*—Boyle Fredrickson Newholm Stein & Gratz S.C.

(57) ABSTRACT

A diaphragm carburetor-based fuel supply system is equipped with an air purge system that vents trapped air from the fuel supply system. The air purge system preferably includes a vent tube having an outlet opening into the upper portion of the system's fuel tank and an inlet located as close as practical to the diaphragm chamber of the carburetor, preferably within an internal passage of the carburetor or at least in a fitting or fuel supply tube portion located closely adjacent the fuel inlet of the carburetor. The resulting system requires only a few pull strokes to start a freshly fueled engine, as opposed to about 15 strokes in a system lacking such an air purge system. It also permits the use of a choke that is incapable of fully closing, thereby negating the need for a "false hit" during cold engine start.

20 Claims, 4 Drawing Sheets

DIAPHRAGM CARBURETOR WITH AIR PURGE SYSTEM

BACKGROUND OF THE INVENTION

1. Field of the Invention

The invention relates to fueling systems and, more particularly, relates to a fueling system utilizing a diaphragm carburetor to form an air/fuel mixture and to supply the mixture to an engine. The invention additionally relates to an engine fueled with such a system and a method of its use.

2. Discussion of the Related Art

Diaphragm carburetors are widely used to supply fuel to relatively small two-stroke and four-stroke utility engines. A diaphragm carburetor has a diaphragm chamber which opens to main jet and idling jet orifices. Fuel flow through the carburetor is controlled by a regulator located in the diaphragm chamber. The regulator continually opens and closes an inlet needle in response to the vacuum created in the carburetor's venturi. Fuel is supplied to the inlet needle via either a diaphragm pump or by gravity. In the case of the diaphragm pump, suction pulses of the engine are used force fuel through the pump and a series of check valves. The resultant volume of pressurized trapped fuel then flows from the regulator chamber to the fuel jet orifices at a rate that depends on the velocity of the air flow through the venturi which depends on the setting of the throttle valve and the speed of the engine.

Unlike float carburetors, diaphragm carburetors do not have to be vented, and do not rely on the position of a float to maintain a desired volume of fuel in the carburetor. Fuel therefore cannot leak out of the carburetor, even if the carburetor is used on a machine that is subject to severe vibrations and/or that is often operated while inverted or lying on its side. Machines of this type include weed trimmers, chain saws, snow blowers, rammers, and breakers.

A relative disadvantage of diaphragm carburetors is that engines fueled by them can be difficult to start, particularly when the engine has run out of fuel. This is because air can be trapped in the carburetor passage upstream of the diaphragm and in the fuel supply tube leading from the fuel tank to the carburetor. This air must be purged and the diaphragm chamber filled with fuel before the engine can start and run. Depending on the length and diameter of the fuel supply tube, this purging requirement can necessitate 15–20 starting pull cord strokes to purge all of the trapped air. This can be very fatiguing to operators.

Many components have been made and mechanisms implemented for improving the startability of small engines. The most common device used today is a so-called "prime bulb." A prime bulb is a cap or bulb mounted on or adjacent to the engine and manually activated by an operator to draw fuel into the carburetor and purge air from it. Prime bulbs can be very effective, but they require manual operation apart from the usual starting operation. Operation of a prime bulb may result in the injection of fuel into the throat of the carburetor. Moreover, activation of a prime bulb when the engine is warm, or when the engine fails to start on the first attempt, can flood the engine so that the engine will not start. Moreover, prime bulbs usually are made of rubber or another resilient material that may become brittle with age and with contact with fuel. They therefore have a limited life. This life is further limited by the imposition of shocks and vibrations on the engine during operation of some implements, such as rammers and breakers.

Another technique that is sometimes employed to improve the cold startability of a diaphragm carburetor-equipped engine is a so-called "closed choke," which is capable of completely or nearly completely closing a choke plate to minimize airflow through the carburetor during a starting operation so as to maximize the richness of the air/fuel mixture. An engine equipped with a closed choke cannot run with the choke fully closed. Instead, the operator must operate the pull cord with the choke closed until he or she detects what is known as a "false hit" in which the engine begins to run but then dies. The operator must then partially or fully open the choke and pull the cord again to start the engine. Closed chokes require even more complex operator interaction than is required for actuation of a prime bulb. They also increase the risk of engine flooding.

The need has therefore arisen to provide a simple, yet reliable mechanism for purging air from a diaphragm carburetor-based fuel supply system in order to facilitate starting of an engine.

SUMMARY OF THE INVENTION

In accordance with a first aspect of the invention, the need identified above is satisfied by providing a fuel system with a vented diaphragm carburetor. Specifically, the engine's fuel supply passage opens into a vent passage that is configured to vent trapped vapor from the fuel supply passage. The fuel supply passage supplies fuel to a metering chamber of the carburetor from the fuel tank. It typically comprises 1) a fuel supply tube that supplies fuel to the fuel inlet of the carburetor from the fuel tank and 2) internal passage(s) supplying fuel to the metering chamber from the fuel inlet of the carburetor. The vent passage preferably comprises a vent tube having an inlet that opens into the fuel supply passage and having an outlet configured to open into an upper portion of the fuel tank. The vent tube inlet preferably opens into either an internal passage in the carburetor, such as into a pump diaphragm chamber of the internal passage, or a downstream portion of the fuel supply tube. The vent passage reduces the number of pull cord actuating strokes required to start a typical two-stroke or four-stroke engine after the engine has run out of fuel and has been refueled. This reduction is from at about 15 pull cord strokes to no more than 5, and even to 3 or less if the vent tube opens into an internal passage of the carburetor. It also can improve steady state operation of the engine by purging fuel vapor from a hot carburetor.

Another benefit of the inventive air purge system is that permits the use of a choke plate that is incapable of being fully closed. For instance, if the choke plate comprises a butterfly valve, the butterfly valve may have at least one aperture formed therethrough through which air passes when the butterfly valve is fully closed. An engine fueled with such a carburetor can start and idle with the choke fully set, hence negating the need to for the operator to detect a false hit and then back off the choke before starting the engine.

The air purge system may also reduce or avoid vapor lock by venting vaporized fuel from the fuel supply passage during engine operation.

Other features and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENT

1. System Overview

The inventive air purge system is usable with virtually any diaphragm carburetor-equipped two-stroke or four-stroke engine. Applications for these engines are also myriad. Hence, while a preferred embodiment of the inventive air purge system will now be described in conjunction with a reciprocating impact tool powered by such an engine, an engine, specifically a rammer, it is to be understood that it is usable with a variety of other powered devices as well.

Figure 1:
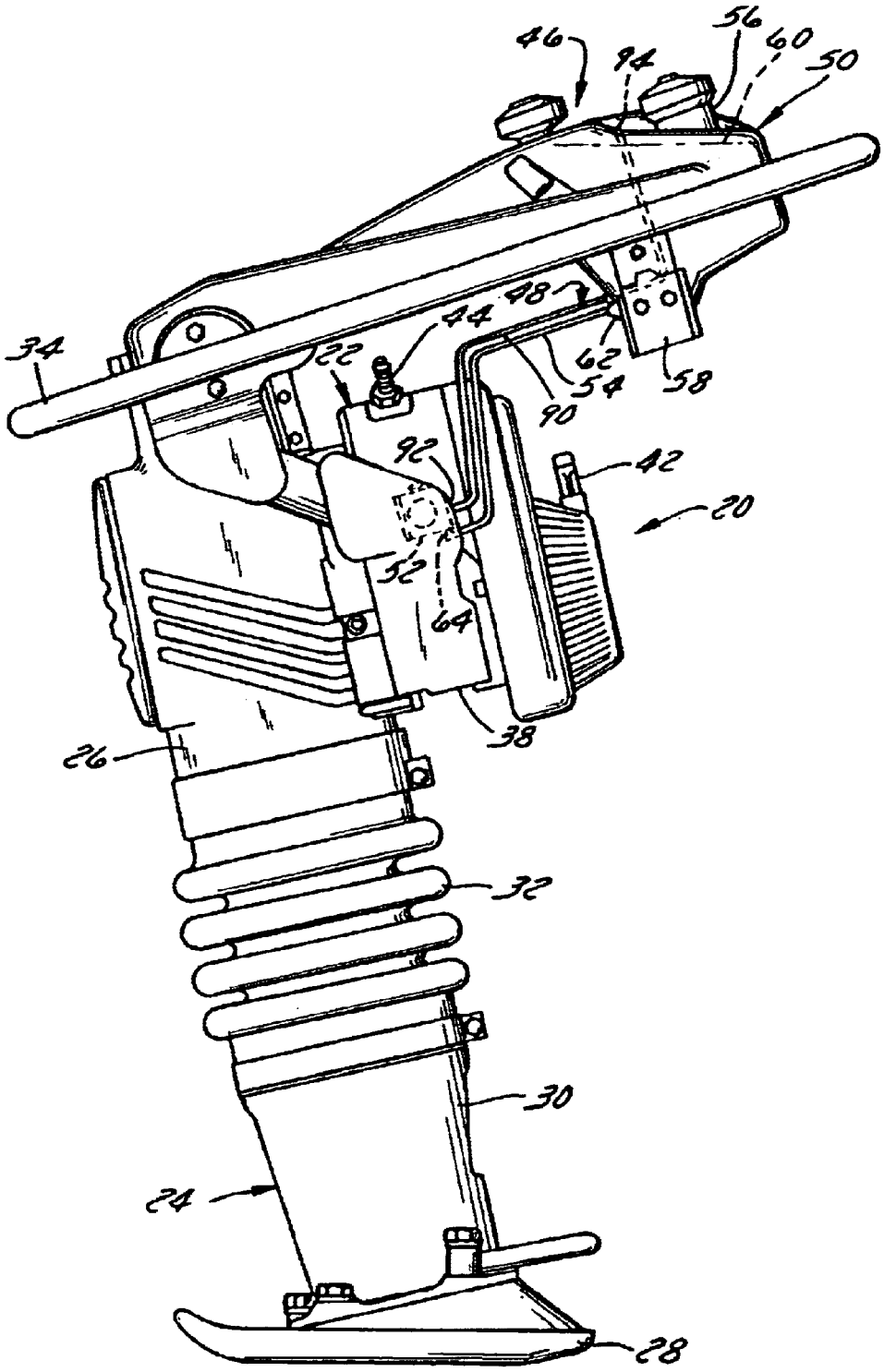
FIG. 1 is a side elevation view of a rammer having an engine fueled by a diaphragm carburetor-based fuel supply system constructed in accordance with a preferred embodiment of the present invention.
Figure 2:
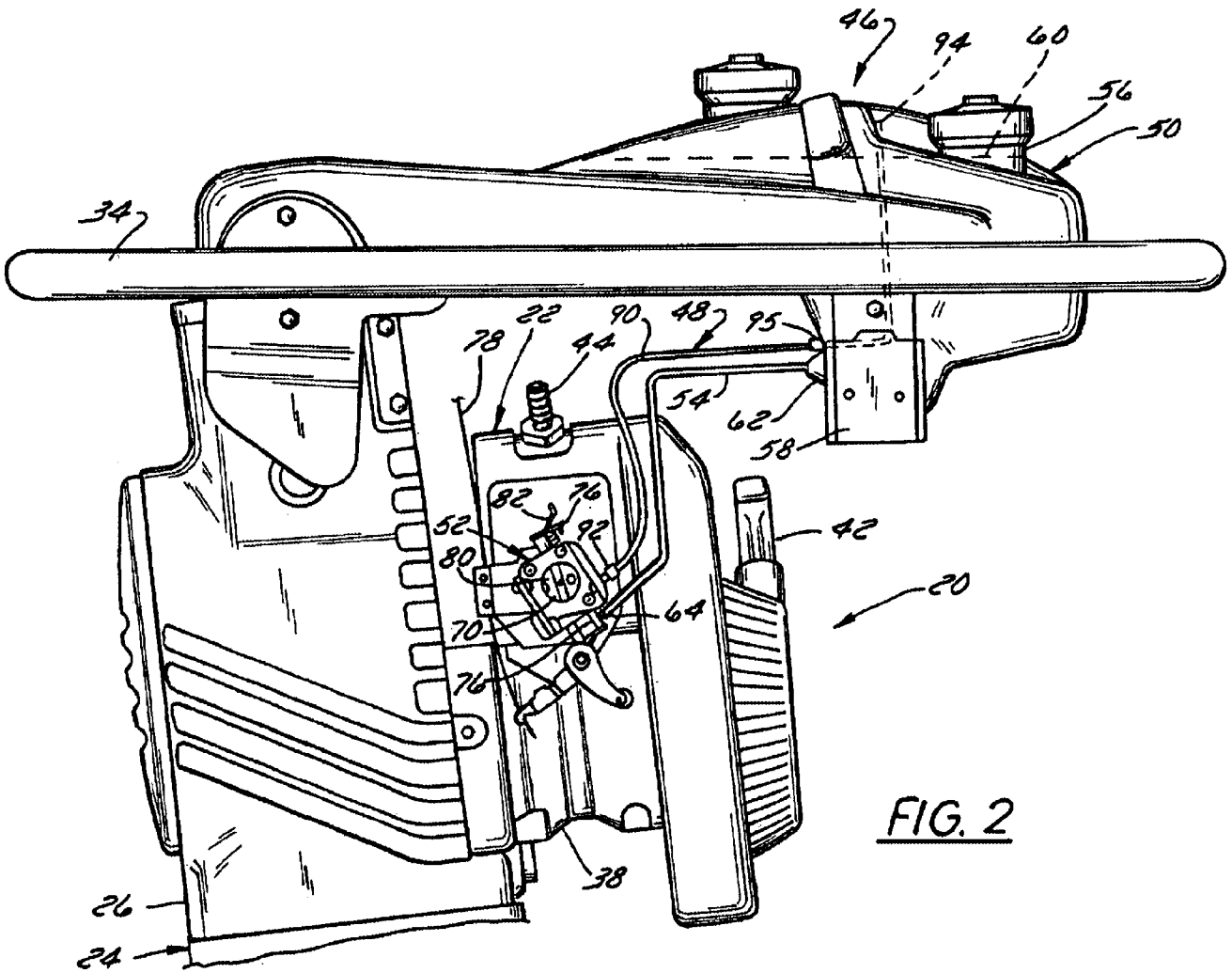
FIG. 2 is a detail view illustrating the engine as located on the upper portion of the rammer of FIG. 1.
Figure 3:
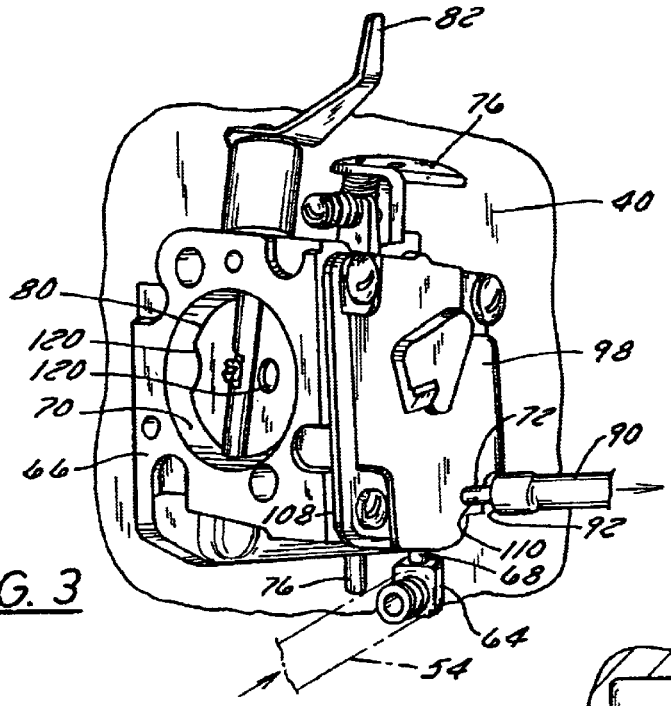
FIG. 3 is a perspective view of the diaphragm carburetor and associated portions of the air purge system of the engine of FIGS. 1 and 2.

Referring now to the drawings and initially to FIGS. 1–3, a rammer (sometimes known as a tamper) 20 is illustrated that includes an engine 22 and a rammer subassembly 24 bolted to one another to form an integral unit. The rammer subassembly 24 includes a rammer crankcase 26 and a reciprocating tamping shoe 28 connected to the rammer crankcase 26 by a reciprocating piston (not shown) so as to oscillate or reciprocate vertically upon rammer operation. The piston is protected at its lower end by a fixed guard 30 and at its upper end by a flexible boot 32 that accommodates movement of the shoe 28 relative to the rammer crankcase 26. The machine is supported and guided by an operator's handle 34 that also serves as a guard.

Still referring to FIGS. 1–3, the engine 22 is a spark ignited, single-cylinder, internal combustion engine. It may comprise either a two-stroke engine or a four-stroke engine. The cylinder (not shown) is encased in a crankcase 38 bolted to a rear surface of the rammer crankcase 26. The engine 22 is started via a pull-cord 42 mounted on the rear surface of the engine crankcase 38.

The engine 22 is supplied with spark via a spark plug 44 and with fuel via a fuel supply system 46. The engine is not equipped with a prime bulb, although one could be provided, if desired. The fuel supply system 46 instead is equipped with an air purge system 48 constructed in accordance with a preferred embodiment of the present invention. The fuel supply system 46, and especially its air purge system 48, will now be described in greater detail.

2. Construction and Operation of Fuel Supply System

Still referring to FIGS. 1 and 2, the fuel supply system 46 comprises an air purge system 48, a fuel tank 50, a carburetor 52, and a fuel supply line 54. The fuel tank 50 is mounted on the frame/handle 34 above the engine crankcase 38. It includes an upper fill port 56, a lower outlet 58, and a hollow interior configured to be filled with fuel to a maximum fill line 60 spaced from the top of the tank 50. The fuel supply line 54 comprises a flexible tube having an inlet connected to the lower outlet 58 of the fuel tank 50 by a first fitting 62 and an outlet coupled to a fuel inlet 68 of the carburetor 52 by a second fitting 64.

Referring to FIGS. 2–5, the carburetor 52 includes a generally rectangular body 66 having the fuel inlet 68, an air inlet 70, and a mixture outlet 74 (FIGS. 6 and 7) which typically takes the form of one or more jets. Airflow into the carburetor 52 is controlled by a throttle 76 that is actuated by a throttle cable 78 in a manner which is, per se, well-known. The air inlet 70 can be selectively partially closed by a choke plate. In the illustrated example, the choke plate takes the form of a butterfly valve 80 operated by a manual choke lever 82. Pursuant to the invention, however, the butterfly valve 80 is not fully closable for reasons detailed below. Air and fuel are drawn through the carburetor 52 from the respective inlets 70 and 64, mixed with one another, and discharged from the outlet 74 under operation of an internal diaphragm pump 84 (FIGS. 6 and 7) located in a diaphragm chamber (not shown). Except for the fact that its choke is not fully closable, the carburetor 52 as thus far described may be of a type commercially available from various manufacturers such as Walbro Corporation of Cass City, Mich. or Tillotson, Ltd. of Ireland. As a point of fact, one of the advantages of the air purge system 48 as it will now be described is that it can be easily incorporated into an existing carburetor design and even retrofitted into a pre-manufactured carburetor. As a further point of fact, the illustrated carburetor 52 is a Tillotson carburetor modified only 1) so that its choke is not fully closable and 2) to mate with the air purge system 48.

The air purge system 48 comprises a vent passage and related couplings that vent fuel from a downstream portion of the fuel passage (formed by the fuel line 54 and the internal passages of the carburetor 52 leading from the fuel inlet 68 to the diaphragm chamber) to a location remote from that portion. A variety of different structures could perform this function. In a particularly preferred embodiment, the vent passage takes the form of a simple flexible vent tube 90 having an inlet 92 and an outlet 94. The vent tube outlet 94 is disposed so as to safely direct vented air, which may be heavy laden with vaporized fuel, to a remote location, preferably the interior of the fuel tank 50. Towards this end, the vent tube outlet 94 preferably opens into the fuel tank 50 at a location above the maximum fill line 60. This effect is achieved most conveniently by running the vent tube 90 up into the fuel tank 50 from a lower vent tube inlet port 95.

Since the vent tube 90 only effectively purges portions of the fuel delivery stream upstream of the vent tube inlet 92, the vent tube inlet 92 is preferably located as close as practical to the diaphragm chamber of the carburetor 52. In the embodiment illustrated in FIGS. 1–6, this effect is obtained by connecting the vent tube inlet 92 to an internal fuel passage in the carburetor 52. Hence, in addition to incorporating the above-described fuel inlet port 68, air inlet port 70, and mixture outlet 74, the carburetor body 66 incorporates a vent port 72 that opens into an internal fuel passage of the carburetor 52.

Figure 4:
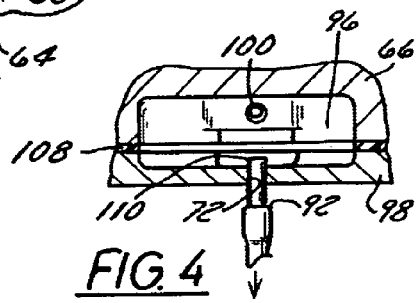
FIG. 4 is a detail view illustrating the connection of an air purge tube of the air purge system to the carburetor of FIG. 3.
Figure 5:
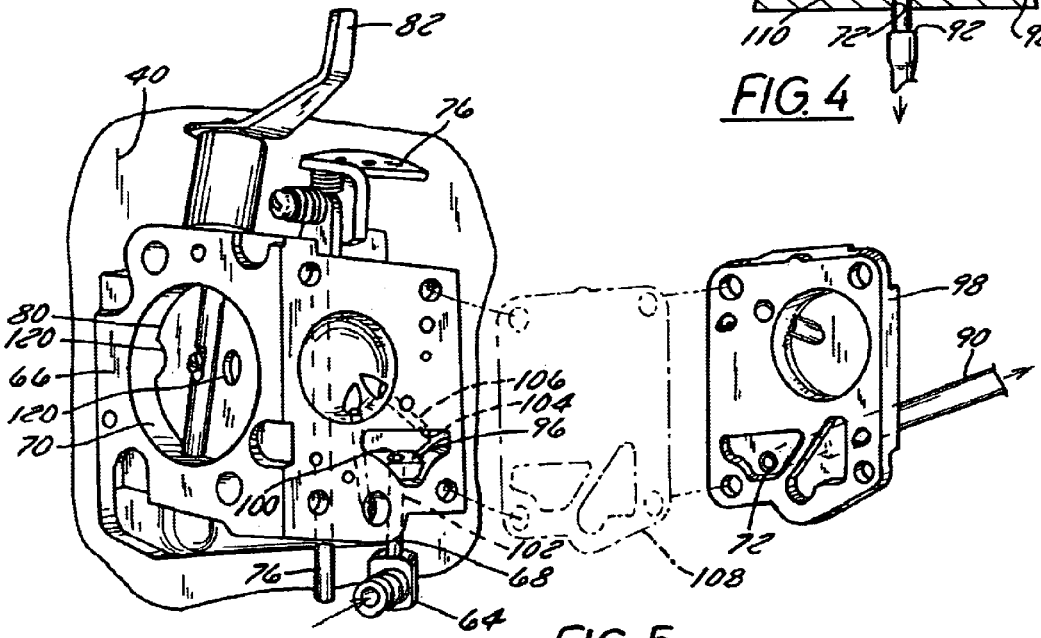
FIG. 5 is a partially exploded perspective view of the carburetor of FIGS. 3 and 4.
Figure 6:
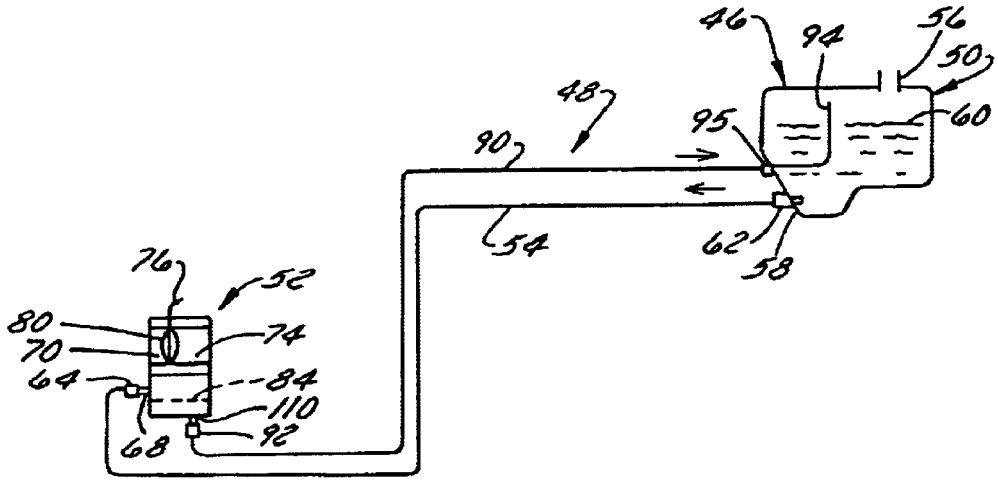
FIG. 6 is a schematic view of the primary components of the fuel supply system of FIGS. 1 and 2.

In the illustrated embodiment in which the carburetor 52 is a Tillotson carburetor, a convenient location for vent port 72 is one in which it opens into an auxiliary or pump diaphragm chamber 96 located on the side of the carburetor body 66. As best seen in FIGS. 4 and 5, chamber 96 can be accessed by removing a cover 98 from the side of the carburetor body 66. The thus-exposed chamber 96 is bounded at one side by a recess in the carburetor body 66 and at another side by a facing recess in the cover 98. The chamber 96 has a fuel inlet 100 connected to the fuel inlet port 68 of the carburetor 52 via a first internal passage 102 in the body 66 and an outlet 104 at least indirectly connected to a main diaphragm chamber, more commonly referred to as a metering chamber, via a second internal passage 106 in the body 66. In the stock carburetor, the outer portion of the chamber 96 typically is separated from the inner portion containing the fuel inlet 100 and fuel outlet 104 by a diaphragm (seen in phantom at 108). However, diaphragm 108 can be removed to provide unrestricted airflow from the inner portion of that chamber 96 to the outer portion thereof when the vent port 72 is drilled into the outer portion of chamber 96 by drilling a hole through the cover 98. When the cover 98 is reattached to the body 66 of the thus-modified carburetor 52, the vent tube inlet 92 can be coupled to the vent port 72 by a suitable fitting 110. Air is now free to flow to the fuel tank 50 from the chamber 96 and all upstream portions of the fuel supply passage via the vent port 72 and the vent tube 90.

Not all diaphragm carburetors may have an internal passage that is easily accessible for connection to a vent tube inlet. In this case, it may be necessary to couple the vent tube inlet 92 to another location in the fuel supply passage. That location should preferably be in the fuel supply tube as close as practical to the carburetor fuel inlet port, such as in the fuel inlet fitting coupling the fuel supply tube to the fuel inlet of the carburetor. An air purge system J148 configured in this manner is illustrated schematically in FIG. 7, in conjunction with the same fuel supply system 46 of FIGS. 1–6. In this system, the fitting 164 connecting the fuel supply tube 54 to the carburetor fuel inlet port 68 takes the form of a T-fitting having a fuel inlet coupled to the outlet of the fuel supply tube 54, a fuel outlet opening to the fuel inlet port 68 of the carburetor 52, and an air outlet coupled to the inlet 92 of the vent tube.

Figure 7:
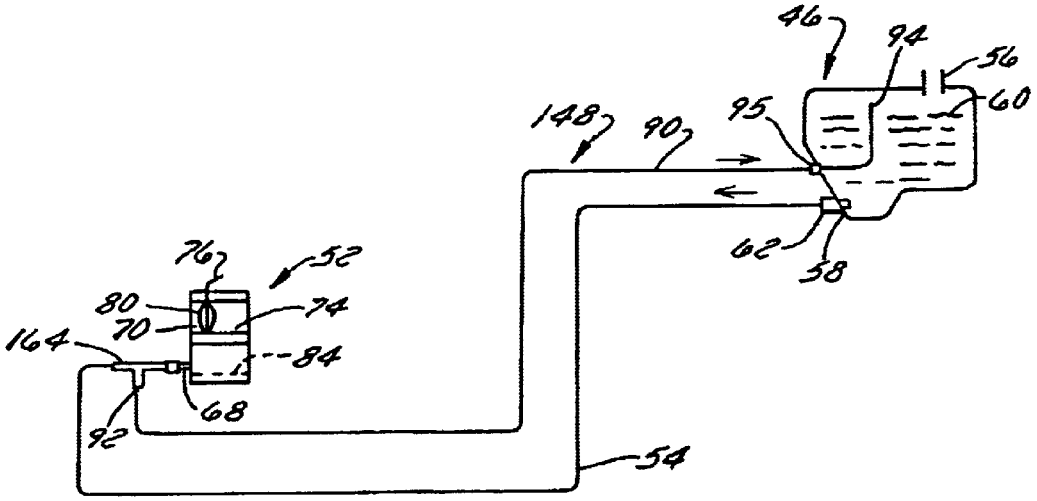
FIG. 7 is a schematic view illustrating an alternative embodiment of a fuel supply system constructed in accordance with the present invention and usable with the engine of FIGS. 1 and 2 and the carburetor of FIGS. 1–5.

Experiments have shown that providing an air purge system having a vent tube inlet opening into the carburetor in the location illustrated in FIGS. 1–6 can dramatically reduce the average number of pulls required to start an engine after it has run out of fuel and the tank refilled. Specifically, the required number of pull strokes required to start the engine 22 typically has decreased from the 15 to 17 range to less than 5 when the air purge system is added to the engine's fuel supply system 46. In fact, the typical, freshly fueled engine can be started with three pull strokes or even less. These benefits have been established experimentally for a two-stroke engine, and are believed to apply equally or nearly equally to a four-stroke engine. The air purge system 148 of the embodiment of FIG. 7 is slightly less effective at improving startability, but still dramatically reduces the number of pulls required to start the engine. It is estimated that the system of FIG. 7 requires no more than 5 to 6 pull strokes to start a freshly fueled engine—still a dramatic improvement over the 15 to 17 that might otherwise be required.

The air purge system as described generally above and more specifically with respect to either the embodiment of FIGS. 1–6 or the embodiment of FIG. 7 offers additional advantages to those described above.

For instance, as mentioned briefly above, it permits the use of a choke that is not fully closable. As mentioned in the Background section above, diaphragm carburetors typically employ a choke plate that must be closed fully prior to engine starting to maximize the richness of the fuel charge during a cold start operation. Also as mentioned above, an engine equipped with this type of carburetor cannot run and remain idling with the choke is fully closed but, instead, is subject to a "false hit" in which the engine runs a few revolutions on its own and then dies. The operator must then partially open or "back off" the choke prior to once again attempting to start the engine. It has been discovered that the inventive air purge system is so effective at obtaining rapid fuel delivery to the carburetor that it is unnecessary to fully close the choke to start a cold engine. Hence, the choke plate can be configured to lack the ability to fully close but, instead, to have a minimum airflow passage that it is a relatively small percentage of the maximum airflow passage. The airflow passage available upon choke plate closure is typically on the order of 5% of the maximum area of the airflow passage. This effect could be achieved, for instance, by providing a stop in the vicinity of the choke plate seat and/or adjacent the choke lever to prevent full choke plate closure. In the illustrated embodiment in which the choke plate comprises a butterfly valve 80, this effect can be achieved simply by drilling one or more apertures 120 in the butterfly valve 80 having a combined area on the order of at least 4%, and preferably about 5% of the total area of the butterfly valve 80. The thus equipped choke allows sufficient airflow through the carburetor 52 to allow the engine to start and run at idle, even when the choke is fully set. The need to obtain a false hit and then open the choke prior to starting the engine therefore is negated.

Still another benefit of the inventive vapor air purge system is that it may prevent vapor lock by venting vaporized fuel from a hot carburetor and thereby preventing the vaporized fuel from backing up into the fuel line.

We claim:

1. A fuel system comprising:

(A) a diaphragm carburetor having a fuel inlet, an air inlet, an air/fuel mixture outlet, and metering chamber;

(B) a fuel supply passage configured to direct fuel from a fuel outlet of a fuel tank, through said fuel inlet of said carburetor, and to said metering chamber of said carburetor; and (C) a vent passage that has an inlet opening into said fuel supply passage and an outlet, wherein said vent passage is configured to vent trapped vapor from said fuel supply passage, said vent passage having an inlet beneath said fuel outlet of said fuel tank.

2. The fuel system as recited in claim 1, wherein said vent passage comprises a vent tube having an inlet and having an outlet configured to open into an upper portion of the fuel tank.

3. The fuel system as recited in claim 2, wherein said carburetor has an internal fuel supply passage leading from said fuel inlet to said metering chamber and forming a portion of said fuel supply passage, and wherein said inlet of said vent tube opens into said internal fuel supply passage.

4. The fuel system as recited in claim 2, wherein said fuel supply passage comprises a fuel supply tube having an outlet coupled to said fuel inlet of said carburetor, and wherein said inlet of said vent tube opens into said fuel supply tube adjacent the outlet thereof.

5. The fuel system as recited in claim 1, wherein said carburetor includes a choke plate that is incapable of being fully closed.

6. The fuel system as recited in claim 5, wherein said choke plate comprises a butterfly valve having at least one aperture formed therethrough through which air passes when the butterfly-valve is fully closed.

7. The fuel system as recited in claim 6, wherein at least 4% of a surface area of the butterfly valve is apertured.

8. An internal combustion engine fueled by the fuel system of claim 1.

9. The internal combustion engine as recited in claim 8, wherein the engine is a two-stroke engine.

10. The internal combustion engine as recited in claim 8, wherein the engine is a four-stroke engine.

11. A ground working appliance powered by the internal combustion engine of claim 8.

12. An internal combustion engine comprising:

(A) a cylinder;

(B) a diaphragm carburetor having a fuel inlet, an air inlet, an air/fuel mixture outlet configured to supply an air/fuel mixture to said cylinder, and a metering chamber located between said fuel inlet and said air/fuel mixture outlet;

(C) a fuel tank having a fuel outlet, a fuel inlet, and a maximum fill line located above said fuel outlet thereof;

(D) a fuel supply passage fluidically connecting said fuel outlet of said fuel tank to said metering chamber of said carburetor, said fuel supply passage including a fuel supply tube having an inlet in fluid communication with said fuel outlet of said fuel tank and an outlet in fluid communication with said fuel inlet of said carburetor; and (E) a vent tube having an inlet and an outlet, said inlet being located physically beneath said fuel outlet of said tank and fluidically in communication between said inlet of said fuel supply tube and said metering chamber in said carburetor, said outlet opening into said fuel tank at a location above said maximum fill line.

13. The engine as recited in claim 12, wherein said carburetor has an internal fuel supply passage leading from said fuel inlet to said metering chamber, and wherein said inlet of said vent tube opens into said internal fuel supply passage.

14. The engine as recited in claim 13, wherein said inlet of said vent tube opens into said fuel supply tube adjacent the outlet thereof.

15. The engine as recited in claim 12, wherein said carburetor includes a choke plate that is incapable of being fully closed.

16. The engine as recited in claim 15, wherein said choke plate comprises a butterfly valve having at least one aperture formed therethrough through which air passes when said butterfly valve is fully-closed.

17. The engine as recited in claim 16, wherein at least 4% of a surface area of said butterfly valve is apertured.

18. The engine as recited in claim 12, wherein the engine is a two-stroke engine.

19. The engine as recited in claim 12, wherein the engine is a four-stroke engine.

20. An internal combustion engine comprising:

(A) a cylinder;

(B) a diaphragm carburetor having a fuel inlet, an air inlet, an air/fuel mixture outlet configured to supply an air/fuel mixture to said cylinder, and an metering chamber located between said fuel inlet and said air/fuel mixture outlet;

(C) a fuel tank having a fuel outlet and a fuel inlet;

(D) a fuel supply passage fluidically connecting said fuel outlet of said fuel tank to said metering chamber of said carburetor, said fuel supply passage including a fuel supply tube leading from said fuel outlet of said fuel tank to said fuel inlet of said carburetor, and an internal passage leading from said fuel inlet of said carburetor to said metering chamber, said internal passage having a pump diaphragm chamber therein; and (E) a vent tube having an inlet and an outlet, said inlet being located physically beneath said fuel outlet of said fuel tank and opening into said pump diaphragm chamber.

* * * * *